US010434357B2

(12) United States Patent
McCarthy

(10) Patent No.: US 10,434,357 B2
(45) Date of Patent: Oct. 8, 2019

(54) DORSIFLEX AND PLANTARFLEX EXERCISE MACHINE

(71) Applicant: Timothy McCarthy, Largo, FL (US)

(72) Inventor: Timothy McCarthy, Largo, FL (US)

( * ) Notice: Subject to any disclaimer, the term of this patent is extended or adjusted under 35 U.S.C. 154(b) by 159 days.

(21) Appl. No.: 15/823,317

(22) Filed: Nov. 27, 2017

(65) Prior Publication Data

US 2019/0160322 A1 May 30, 2019

(51) Int. Cl.
*A63B 21/04* (2006.01)
*A63B 21/00* (2006.01)
(Continued)

(52) U.S. Cl.
CPC .... *A63B 21/0421* (2013.01); *A63B 21/00069* (2013.01); *A63B 21/00181* (2013.01);
(Continued)

(58) Field of Classification Search
CPC ..... A63B 21/00058; A63B 21/00061; A63B 21/00065; A63B 21/00069; A63B 21/00072; A63B 21/00076; A63B 21/00178; A63B 21/00181; A63B 21/00185; A63B 21/002; A63B 21/0023; A63B 21/02; A63B 21/023; A63B 21/025; A63B 21/026; A63B 21/028; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/055; A63B 21/0552; A63B 21/0555; A63B 21/0557; A63B 21/0615; A63B 21/0616; A63B 21/0617; A63B 21/065; A63B 21/068; A63B 21/08; A63B 21/15; A63B 21/151; A63B 21/159; A63B 21/22; A63B 21/4011; A63B 21/4013; A63B 21/4015; A63B 21/4027; A63B 21/4029; A63B 21/4031; A63B 21/4033; A63B 21/4034; A63B 21/4039; A63B 21/4047; A63B 21/4049; A63B 22/0046; A63B 22/0048; A63B 22/0058; A63B 22/16; A63B 22/18; A63B 2022/0051; A63B 2022/0094; A63B 2022/0097; A63B 2022/185; A63B 23/035; A63B 23/03508; A63B 23/03516; A63B 23/03525; A63B 23/03533;
(Continued)

(56) References Cited

U.S. PATENT DOCUMENTS 2,720,396 A * 10/1955 Pfaus ..... A63B 23/03533 482/130
3,295,847 A * 1/1967 Matt, Sr. ..... A63B 22/16 482/128

(Continued)

*Primary Examiner* — Gary D Urbiel Goldner
(74) *Attorney, Agent, or Firm* — Justin Luby

(57) ABSTRACT

A therapeutic rehabilitation device utilizing two parallel independent foot pedals on one side of the device, for isolated ankle exercises, and a larger flat board on the other side of the device, large enough for two feet to rest on, for use in active assistance exercises. To use the device for active assistance rehabilitation, the user places the device on the ground with the two pedals resting on the ground. To use the device for active isolated exercise, the user flips the device over, with the flat board facing the ground, and the two pedals facing upward.

10 Claims, 12 Drawing Sheets

(51) Int. Cl.

| | |
|---|---|
| ***A63B 69/00*** | (2006.01) |
| ***A63B 21/055*** | (2006.01) |
| ***A63B 21/02*** | (2006.01) |
| ***A63B 23/08*** | (2006.01) |

(52) U.S. Cl.
CPC ..... *A63B 21/025* (2013.01); *A63B 21/0552* (2013.01); *A63B 21/4034* (2015.10); *A63B 21/4047* (2015.10); *A63B 23/08* (2013.01); *A63B 69/0057* (2013.01)

(58) Field of Classification Search
CPC . A63B 23/03541; A63B 23/08; A63B 23/085; A63B 26/00; A63B 26/003; A63B 69/0057; A63B 69/0059; A63B 2069/0062; A63B 71/0054; A63B 2071/0063; A63B 2071/0072; A63B 2208/0204; A63B 2208/0209; A63B 2208/0228; A63B 2208/0233; A63B 2225/09; A63B 2225/093; A63B 2225/10; A63B 2225/102
See application file for complete search history.

(56) References Cited

U.S. PATENT DOCUMENTS 3,741,540 A * 6/1973 Shimizu ..... A63B 22/0056 482/80
4,279,415 A * 7/1981 Katz ..... A63B 69/0035 36/7.8
4,422,635 A * 12/1983 Herod ..... A63B 23/03533 248/464
4,501,421 A * 2/1985 Kane ..... A63B 23/085 482/118
5,178,596 A * 1/1993 McIntire ..... A63B 21/0552 482/122
5,267,923 A * 12/1993 Piaget ..... A63B 21/0085 482/52
5,368,536 A * 11/1994 Stodgell ..... A63B 21/00072 482/123
5,413,543 A * 5/1995 Drago ..... A63B 23/085 482/123
5,755,651 A * 5/1998 Homyonfer ..... A63B 22/16 482/123
5,851,166 A * 12/1998 Bernardson ..... A63B 22/16 482/79
5,891,002 A * 4/1999 Maki ..... A63B 22/16 482/146
6,705,975 B2 * 3/2004 Kuo ..... A63B 22/0056 482/51
7,364,534 B2 * 4/2008 Zoller ..... A63B 23/08 482/79
8,029,420 B1 * 10/2011 Thati ..... A63B 21/023 482/79
8,827,882 B2 * 9/2014 Rogers ..... A63B 26/003 482/146
2011/0028870 A1 * 2/2011 Greenburg ..... A63B 21/062 601/27
2011/0092339 A1 * 4/2011 Stewart ..... A43B 13/18 482/52
2011/0111927 A1 * 5/2011 Kim ..... A63B 21/00192 482/52
2019/0076696 A1 * 3/2019 Townsend ..... A61H 1/0266

* cited by examiner

DORSIFLEX AND PLANTARFLEX EXERCISE MACHINE

CROSS-REFERENCE TO RELATED APPLICATIONS

Not Application

FIELD OF THE INVENTION

The present invention relates to the field of therapeutic rehabilitation devices, in particular, to devices facilitating exercise and rehabilitation of the ankle following medical complications or physical injury to the ankle and corresponding muscle groups.

BACKGROUND

The ankle joints and muscles are very important for various physical functions such as safe ambulation (walking), stair climbing, and for balancing. The ankle joint is capable of a wide range of motion including dorsiflexion and plantar flexion. Dorsiflexion brings the toes upward and closer to the front of the leg and plantar flexion points the toes downward, curling the sole of the foot under and deepening the arch of the foot. In addition, the ankle muscles, tibialis anterior and the gastrocnemius-soleus unit muscle groups, are critical in the proper functioning of the ankle. The tibialis anterior is an extensor muscle of the anterior compartment of the leg which acts to extend the toes and to produce dorsiflexion. The gastrocnemius-soleus unit muscle groups is a prominent flexor muscle group forming the calf muscles. Together with the Achilles tendon, the gastrocnemius-soleus unit muscle group act to lift the heel and to produce plantar flexion.

Therefore, when injury occurs to the ankle joints and muscles it is imperative to rehabilitate and exercise them, if possible, in order to restore stability and range of movement, increase strength, and recover neurological capacities so that the victim of the injury can walk again. This is possible by exercising one ankle, if only one ankle has been injured, or both ankles on a device which is capable of isolating the movement of the ankle or ankles to forward and backward motion and thereby, to pure and isolated dorsiflexion and plantar flexion. In addition, exercising a strong, healthy ankle with a weak ankle at the same time will aid rehabilitation of the weak ankle, if the weak ankle is not capable of these exercises on its own.

One way this can be accomplished is by exercising the muscles surrounding the ankle, lower leg and foot through a desired range of motion on a device that can provide resistance to such movement. Indeed, a frequently neglected muscle group for exercise injury prevention and rehabilitation is the shin. The major muscles responsible for dorsiflexion (i.e., tibialis anterior and extension hallicusis longus) are all present in the shin area. Moreover, by strengthening the muscles in the lower leg and foot, one may significantly reduce the possibility of future ankle injuries. Additionally, by improving strength and range of motion, balance can be improved.

The prior art devices designed to exercise and rehabilitate ankles can be characterized by different tensioning structures capable of movement in various directions. For example, U.S. Pat. No. 5,368,536 discloses an Ankle Rehabilitation Device that is capable of exercising one ankle at a time in multiple directions. This device discloses a plurality of attachment points extending around the perimeter of the foot receiving platform for providing the various directions of exercise. The device also provides a resistance means and an adjustment means to vary the resistance. However, this device only exercises one ankle at a time, strapped by straps and does not allow the user to use a strong ankle and foot to assist the weak ankle and foot in the therapy. Moreover, the device utilizes a complex two bar linkage mounted at one end to the base plate and at the other end to one of a plurality of attachment points on the foot receiving platform where a coilspring is operatively connected between the bars of the linkage to adjust the resistance on the machine and does not provide an adjustment means to vary the resistance by adjusting the location of the foot location on the foot receiving platform relative to the pivot point.

Prior art device U.S. Pat. No. 5,891,002 discloses an orthopedic device comprising a foot board, pivot means, and fastening means allowing exercise boards mounted on a roller that is secured to the assembly by a retainer pin allowing the user to use "active assistance" where a strong ankle and foot to assist the weak ankle and foot in the therapy. However, this device does not provide a function to add additional resistance to the device to continue therapy using the device once the weak ankle is strong enough to require additional resistance to continue rehabilitation.

Prior art device U.S. Pat. No. 7,364,534 discloses an exercise device for providing resisted movement of the ankle through the full range of motion thereof to exercise the muscles in the ankle, foot, lower leg and especially shin area. This exercise device comprises: (a) a base; and (b) a foot receiving member having an ankle section. The foot receiving member is mounted on the base for resisted pivotal movement about: (1) a substantially horizontal axis extending transversely and underneath the ankle section of the foot receiving member; and (2) a substantially vertical axis extending from the base and through the ankle section of the foot receiving member. However, this device only exercises one ankle at a time, and does not allow the user to use a strong ankle and foot to assist the weak ankle and foot in the therapy. Moreover, the device utilizes frictional pads to adjust the resistance on the machine and does not provide an adjustment means to vary the resistance by adjusting the location of the foot location on the foot receiving platform relative to the pivot point.

Accordingly, there is a need for a single therapeutic rehabilitation device which can be utilized to strengthen the muscles of the ankle, foot and lower leg for users who injuries may be so severe that active assistance is needed during the rehabilitation process, as well as users further along in the recovery process, where additional resistance is needed to further advance recovery.

Additionally, there is a need for a therapeutic rehabilitation device where resistance adjustment can be achieved by adjusting simply and economically through adjustment of the location of the foot restraints relative to the pivot point on the device, thereby alleviating the need to purchase multiple pieces of equipment and reduce the storage area required for the equipment.

Furthermore, there is a need for a therapeutic rehabilitation device where resistance can be grade-able or measurable, to track the status and progress of the patients during rehabilitation.

Finally, there is a need for a therapeutic rehabilitation device where resistance compact and portable for ease of storage.

SUMMARY

The present disclosure pertains to a single therapeutic rehabilitation device which is capable of both active assisted exercises, where both ankles work in tandem to complete the exercise movements, as well as isolated exercises, where each ankle performs the exercise without assistance.

The therapeutic rehabilitation device of the current invention utilizes two parallel independent foot pedals on one side of the device, for isolated ankle exercises, and a larger flat board on the other side of the device, large enough for two feet to rest on, for use in active assistance exercises. In the resting position, the two pedals and the large flat board are horizontal.

Connecting the two pedals and the large flat board is at vertically oriented connecting board, that is perpendicular to the two pedals and the large flat board. The vertically oriented connecting board is located at and connected to approximately the midpoint of both of the pedals and the large flat board. The two pedals are attached to the vertically oriented connecting board using a separate pivoting joints to connect each pedal, so that the pedals can operate independently.

Each pedal is connected to the large flat board by two sets of elastic bands, one set located on either side of the pivoting joints.

Each pedal incorporates a movable heel rest and strap to secure the foot in place while exercising. The resistance can be increase of decreased by adjusting the location of the users foot relative the pivot point created by the pivoting joints. The closer the heel of the users foot is to the pivot point, the greater the resistance. The status and progress of the patient can be graded by the resistance of the bands and location of the users foot.

The large flat board also incorporates two straps and frictional pads to secure the feet in place while exercising.

When the user wants to use the therapeutic rehabilitation device for active assistance rehabilitation, the user places the device on the ground with the two pedals resting on the ground, and the large flat board, two straps and frictional pads to secure the feet facing upward.

When the user wants to use the therapeutic rehabilitation device for active isolated exercise, the user flips the device over, with the flat board, two straps and frictional pads to secure the feet facing the ground, and the two pedals facing upward.

The overall therapeutic rehabilitation device is compact in size and incorporates a handle portability and ease of storage.

Other aspects of the present invention will become apparent from the following detailed description, taken in conjunction with the accompanying drawings, which illustrate, by way of example, the principles of the invention.

DETAILED DESCRIPTION OF THE INVENTION

Figure 1:
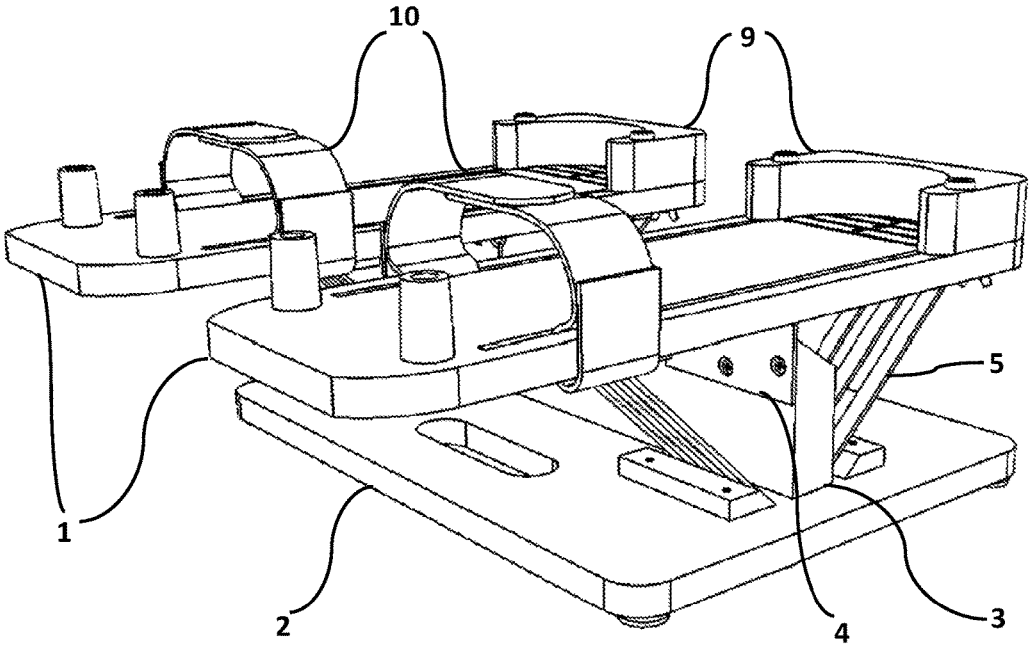
FIG. 1 illustrates a front, perspective view drawing of the therapeutic rehabilitation device where the pedals are facing up, for isolation exercising.
Figure 2:
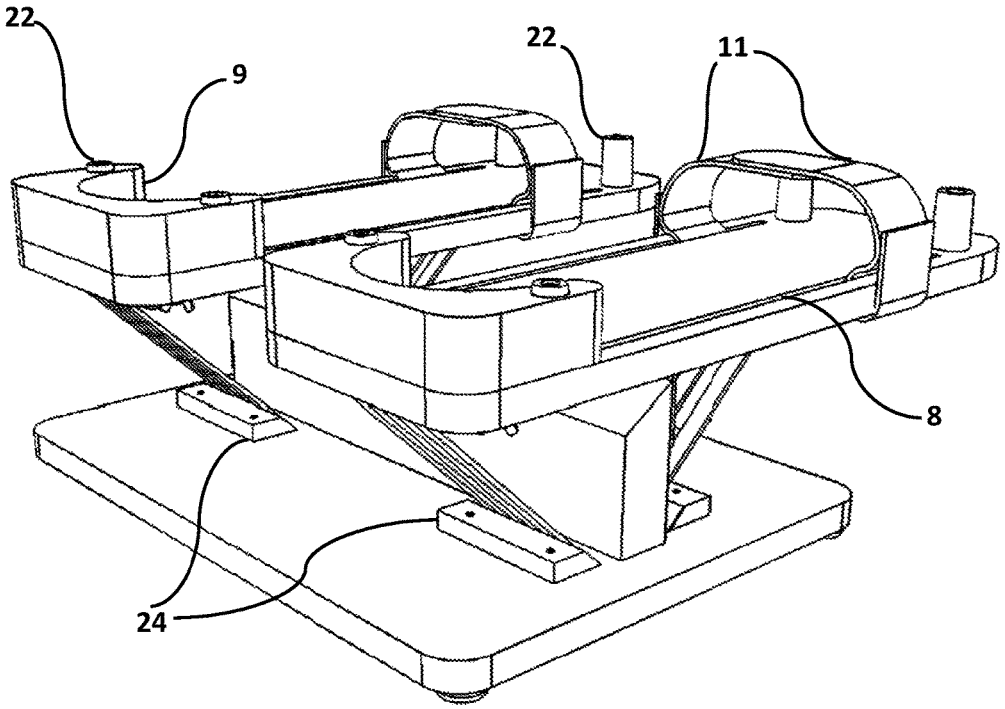
FIG. 2 illustrates a rear, perspective view drawing of the therapeutic rehabilitation device where the pedals are facing up, for isolation exercising.
Figure 3:
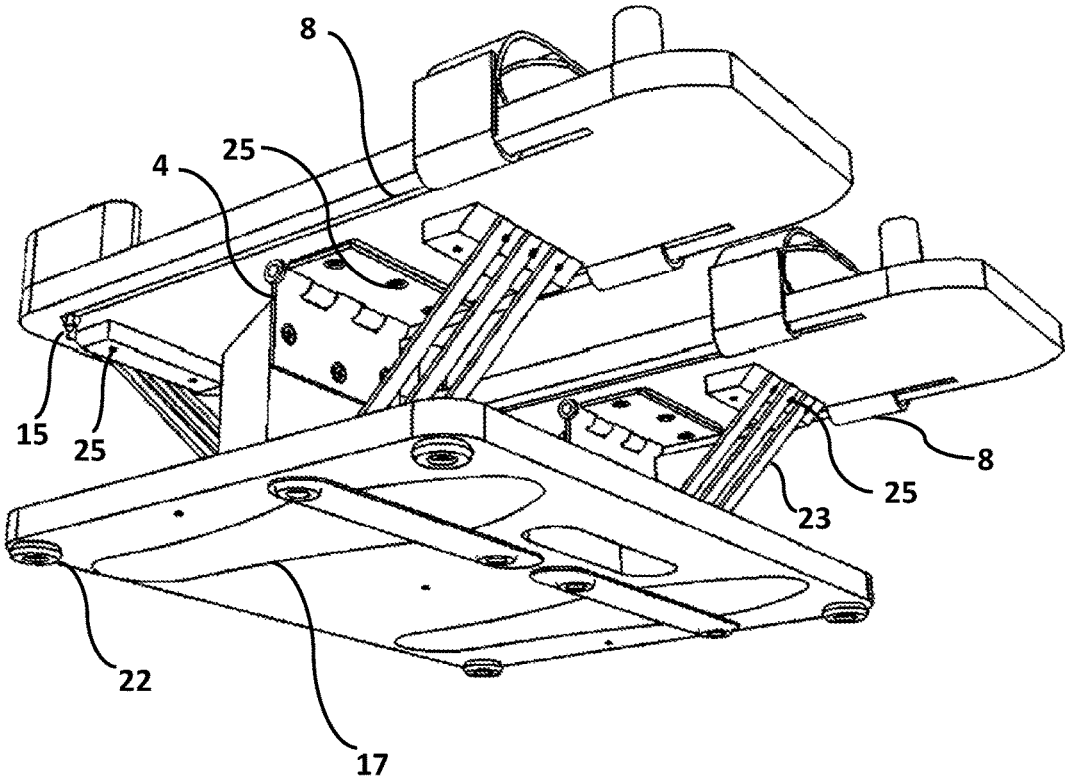
FIG. 3 illustrates a front, underside perspective view drawing of the therapeutic rehabilitation device.

The present invention provides for a therapeutic rehabilitation device for the lower leg section of a patient that allows the patient to perform both active assistance exercises as well as isolation exercises on a single device. Referring to FIGS. 1, 2, & 3, the device is primarily comprised of two independent foot pedals 1, and dual footboard piece 2, a vertical support structure 3, two pivoting joint structures 4, and a resistance means 5.

Figure 4:
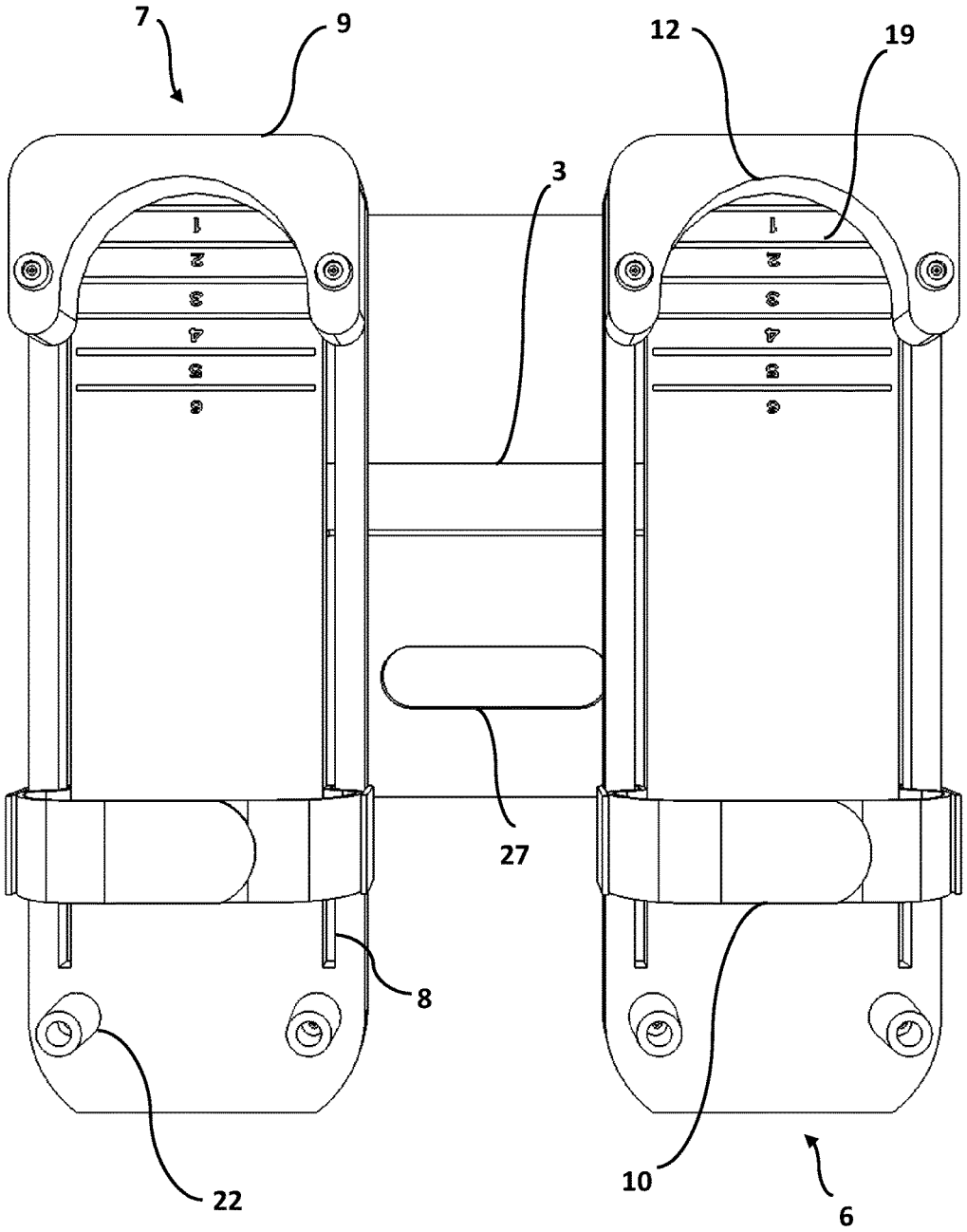
FIG. 4 illustrates a underside view drawing of the therapeutic rehabilitation device where the pedals are facing up, for isolation exercising.
Figure 6:
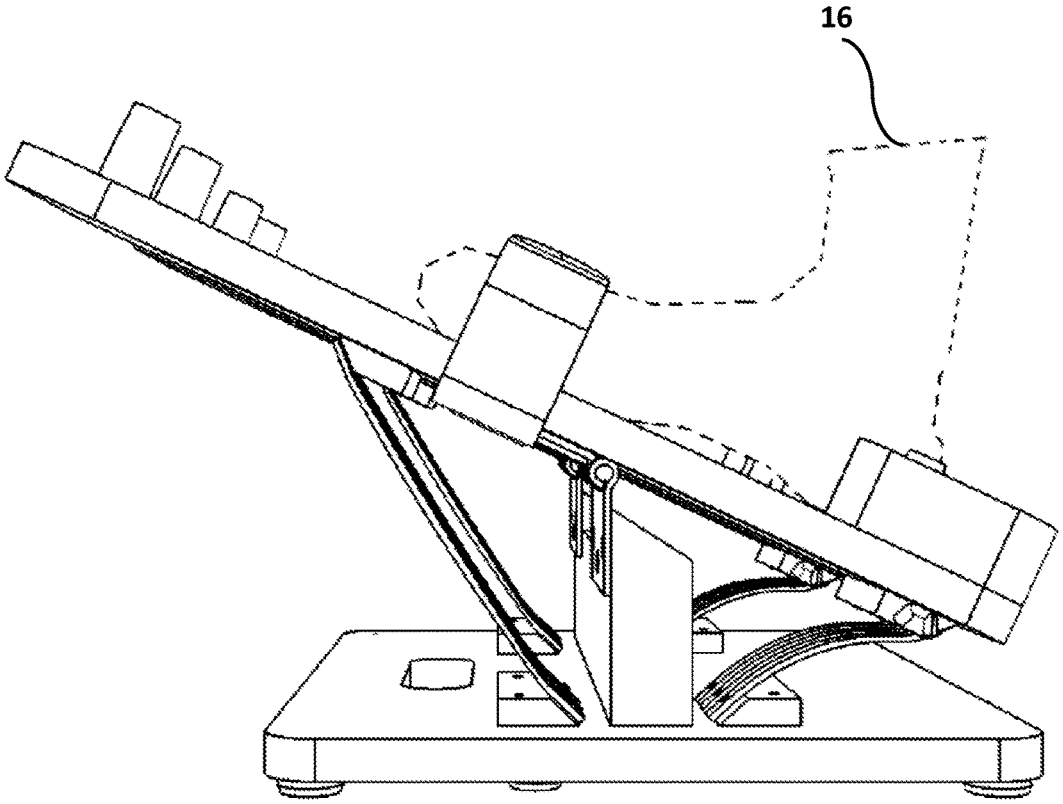
FIG. 6 illustrates a side view drawing of the therapeutic rehabilitation device where the pedals are facing up, for isolation exercising, with the heel piece and straps oriented to a position to create the least resistance, depicting a dorsiflexion exercise.

Referring to FIGS. 4, & 6, each foot pedal 1 has a front side 6 and rear side 7. Running the length of each foot pedal 1, are guides 8, a rear heel-support 9, foot restraint 10 and a plurality of feet 22.

In the preferred embodiment, the length of the foot pedal 1 should be approximately twice the length of the foot 16 of the user. This way, the user can place his heel at the pivot point of the pedal 1 for maximum resistance, or place his toes at the pivot point of the pedal 1 for minimum resistance.

In the preferred embodiment, the guides 8 comprise two slots which travel substantially the length of the foot pedals 1 from the front side 6, to the rear side 7. The guides 8 function to allow for adjustment of the location of the rear heel-stop 9 and the foot restraint 10, so the user can adjust the location of the foot on the foot pedal 1 to vary resistance levels, and also to adjust for larger and smaller feet.

The preferred embodiment utilizes slots to perform the function of the guides 8, due to the ease of manufacture and the associated low costs. However, there are a number of means which those skilled in the art could use to perform the function of adjusting the location of the rear heel-stop 9 and the foot restraint 10, including but not limited to rails and slides.

In the preferred embodiment, the rear heel support 9 comprises a semi-circular section 12 and two bolts which protrude through the and beyond the rear heel support 9. The two bolts are aligned with guide slots 8 and have threaded ends which protrude far enough past the rear heel support 9 so that when the rear heel support 9 is mounted on the foot pedal 1 that the threaded ends extend through the guide slots 8 and can have wingnuts 15 attached to the threaded ends to secure the rear heel support 9 to the foot pedal 1. When the user needs to adjust the location of the rear heel support 9 to modify the resistance, the user will simply loosen the wingnuts 15 and slide the rear heel support 9 to its desired position and then tighten the wingnuts 15.

In the preferred embodiment, the top of the foot pedal 1 is marked with a plurality of resistance designations 19. The resistance designations 19 are used to repeatedly locate the rear heel support 9 at the proper location for the desired resistance level. The resistance designations 19 allow therapeutic rehabilitation device to be grade-able for clinical use, so that the status and progress of the patients to be measured against standards.

In the preferred embodiment, the foot restraint 10 is a constructed of two straps 11 of a hook and loop material each with a loop end 13 where the hook and loop material is threaded through one of the guides 8 and then fastened to itself. Each strap 11 also has a connecting end which allows the two straps 11 to be connected to each other. Attaching the straps 11 to the foot pedal 1 through the guides 8 allows the foot restraint 10 to slide along the length of the foot pedal 1.

The preferred embodiment utilizes a two straps 11 of a hook and loop material each with a loop end 13 where the hook and loop material is threaded through one of the guides 8 and then fastened to itself to perform the function of securing the users foot 16 to the pedal. However, there are a number of means which those skilled in the art could use to perform the function of securing the users foot 16 to the pedal, including but not limited to belts with buckles, clamping devices, and ratcheting belts.

In the preferred embodiment of the invention, a plurality of feet 22 are mounted on the topside of the pedal 1 and rear heel support 9. The feet 22 are not critical to the operation of the apparatus, but serve as a means to provide resistance to prevent the apparatus from sliding on the ground during use, as well as provide a means to protect the floor surface from any damage from apparatus.

Figure 5:
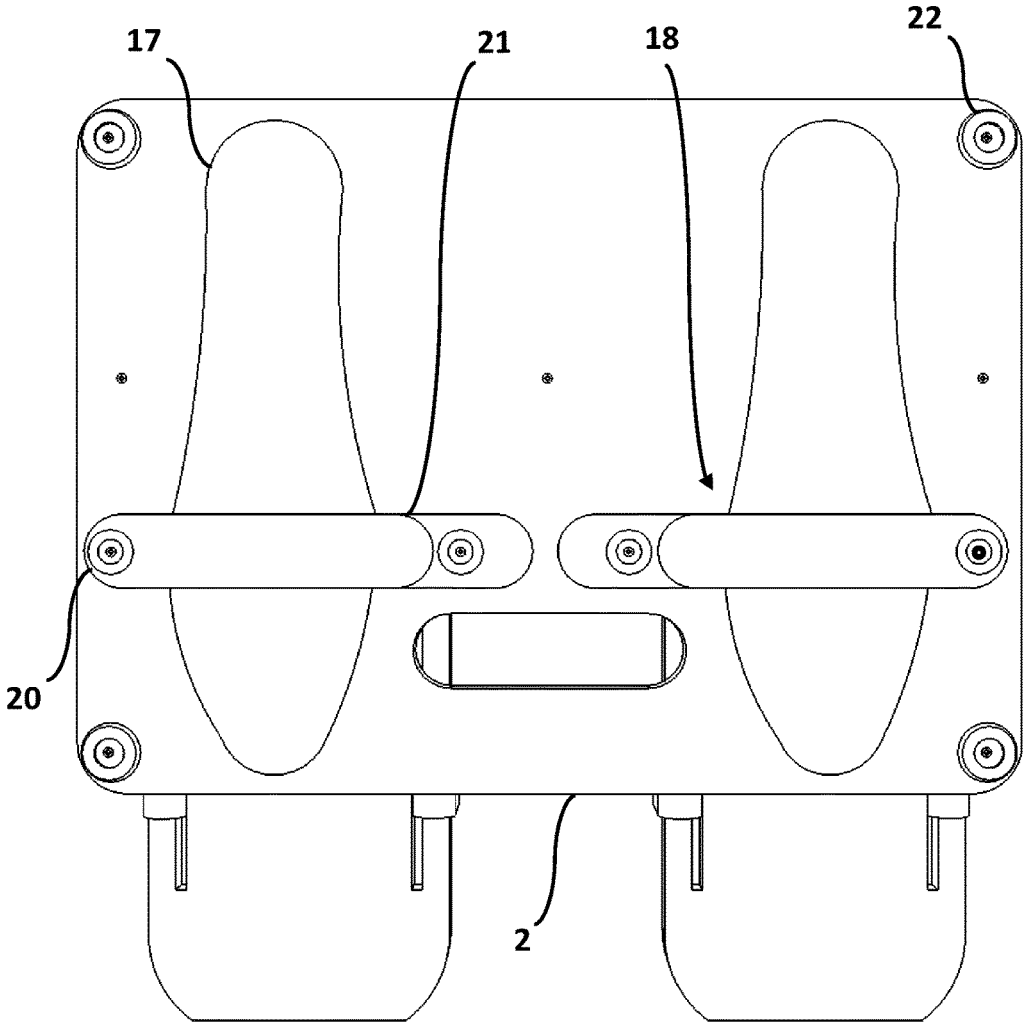
FIG. 5 illustrates a illustrates a top view drawing of the therapeutic rehabilitation device where the large foot board is facing up, for active assistance exercising.
Figure 10:
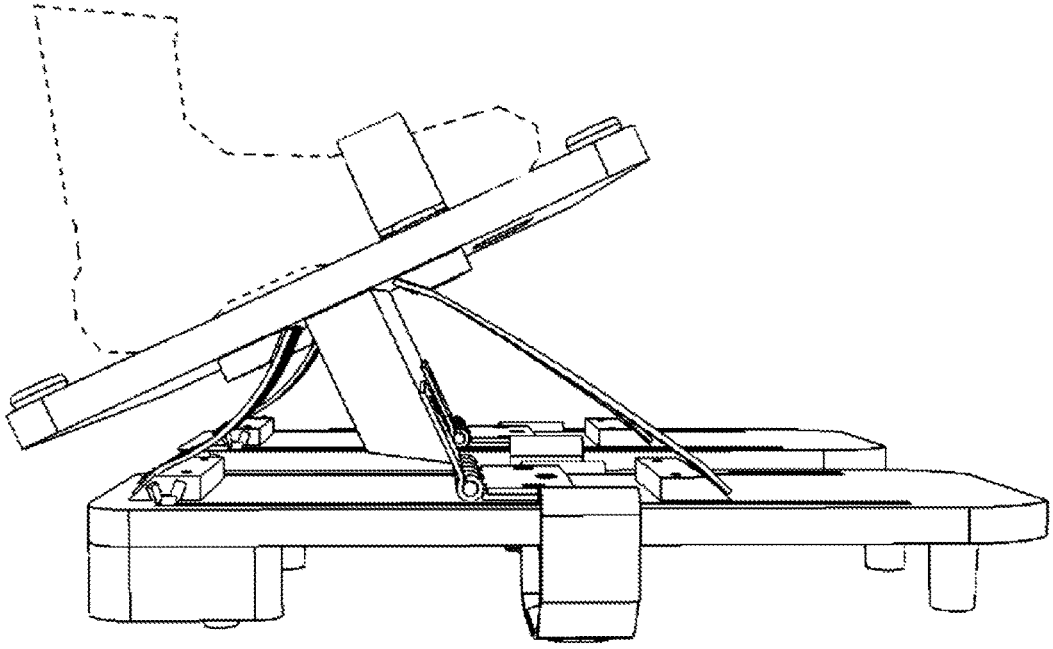
FIG. 10 illustrates a side view drawing of the therapeutic rehabilitation device where the large foot board is facing up, for active assistance exercising, depicting a dorsiflexion exercise.

Referring to FIGS. 5 & 10, the dual footboard piece 2 comprises a rectangular board with two footpads 17, two foot restraints 18, a plurality of feet 22, and a handle 27.

In the preferred embodiment, the two foot restraints 18 are constructed of two straps of a hook and loop material each with a fixed end 20 where the straps are attached the dual footboard piece 2. Each strap also has a connecting end 21 which allows the two straps 20 to be connected to each other.

The preferred embodiment utilizes a two foot restraints 18 of a hook and loop material each with a fixed end 20 where the straps are attached the dual footboard piece 2 to perform the function of securing the users foot 16 to the dual footboard piece 2. However, there are a number of means which those skilled in the art could use to perform the function of securing the users foot 16 to the dual footboard piece 2, including but not limited to belts with buckles, clamping devices, and ratcheting belts.

In the preferred embodiment of the invention, two footpads 17 are mounted on the topside of the dual footboard piece 2. The footpads 17 are not critical to the operation of the apparatus, but serve as a means to instruct the users where to position their feet 16 and to provide resistance to prevent the feet 16 from shifting during use. In the preferred embodiment the footpads 17 are constructed of a foam material, but could be constructed of a number of other materials known to those skilled in the art, including, but not limited to sandpaper and rubber.

In the preferred embodiment of the invention, a plurality of feet 22 are mounted on the topside of the dual footboard piece 2. The feet 22 are not critical to the operation of the apparatus, but serve as a means to provide resistance to prevent the apparatus from sliding on the ground during use, as well as also provide a means to protect the floor surface from any damage from apparatus.

In the preferred embodiment of the invention, a handle 27 is integrated into the dual footboard piece 2 by cutting an oval hole into one side of the dual footboard piece 2. The handle provides a gripping location, to increase the portability of the device.

Connecting the underside of the pedals 1 and the dual footboard piece 2 is a vertical support structure 3. The vertical support structure 3 is located laterally at approximately the midpoints of the pedals 1 and the dual footboard piece 2. The vertical support structure provides vertical separation between the pedals 1 and the dual footboard piece 2 so that the pedals 1 and the dual footboard piece 2 can pivot the full range of motion necessary to property exercise the ankles.

In the preferred embodiment the vertical support structure 3 is fixedly attached directly to the dual footboard piece 2 using screws 25, however, other known attachment means including, but not limited to adhesives and brackets could be used.

In the preferred embodiment the vertical support structure 3 is not attached directly to the foot pedals 1, but is instead attached directly to one end of the two pivoting joint structures 4 using screws, however, other known attachment means including, but not limited to adhesives and staples could be used. The other end of the two pivoting joint structures 4 are attached to the underside of the foot pedals 1 using screws, however, other known attachment means including, but not limited to adhesives and staples could be used.

In the preferred embodiment the to the two pivoting joint structures 4 are hinges, but could be a variety of pivoting joint structures known to those skilled in the art, including but not limited to a ball and socket joint, condyloid joint, and saddle joint.

Connecting the underside of the pedals 1 and the dual footboard piece 2 are a plurality of resistance means 5, which take the form of elastic bands 23 in the preferred embodiment. In the preferred embodiment, the elastic bands 23 are connected to the pedals 1 and the dual footboard piece 2 using angled wedge pieces 24. The angled wedge pieces 24 allow the elastic bands 23 to connect to the pedals 1 and the dual footboard piece while remaining straight, reducing the possibility of stress points which could lead to breakage.

In the preferred embodiment, the elastic bands 23 have measured and designated resistance levels. The used of elastic bands 23 which are measured and designated resistance levels allows the therapeutic rehabilitation device to be grade-able for clinical use, to allow for status and progress of the patients to be measured against standards.

In the preferred embodiment the angled wedge pieces 24 are fixedly attached directly to the pedals 1 and the dual footboard piece 2 using screws 25, however, other known attachment means including, but not limited to adhesives and brackets could be used.

In the preferred embodiment the elastic bands 23 are fixedly attached directly to the angled wedge pieces 24 using screws 25, however, other known attachment means including, but not limited to adhesives and hooks could be used. Using elastic bands 23 with looped ends in conjunction with hooks, would allow for the elastic bands 23 to be easily replaced with elastic bands 23 with different elasticity for more or less resistance.

Referring to FIGS. 6 thru 9, when the user wants to use the pedals 1 to exercise perform isolation exercises, the user will place the apparatus on the ground with the top of the dual footboard piece 2 facing the floor. The feet 22 will protect the floor from damage.

Referring to FIG. 6, when the user wants to use the pedals 1 to exercise perform a dorsiflexion exercise at minimum resistance, the user will position rear heel supports 9 at the midpoint of the pedals 1 so that the heel of the foot 16 is located above the pivoting joint structures 4 and use the foot restraints 10 to secure the foot 16. The user will then rotate his ankle clockwise and the front resistance means 5, which take the form of elastic bands 23 in the preferred embodiment will stretch, creating resistance, and the rear elastic bands 23 will sag, and not generate any resistance.

Figure 7:
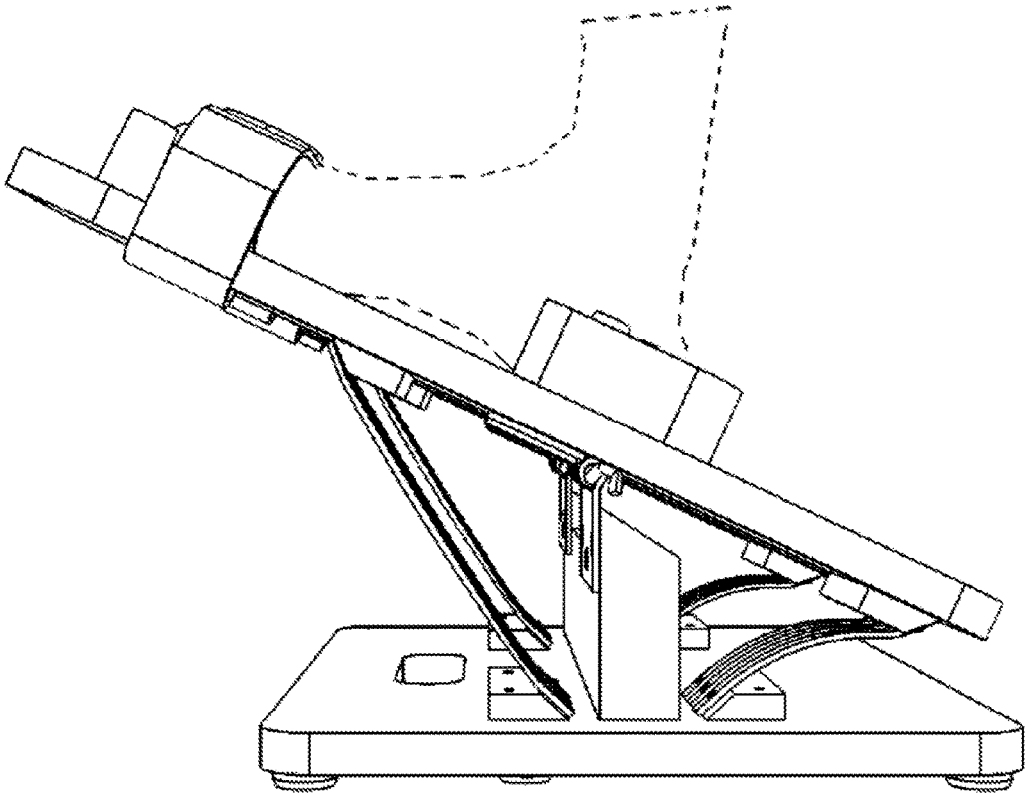
FIG. 7 illustrates a side view drawing of the therapeutic rehabilitation device where the pedals are facing up, for isolation exercising, with the heel piece and straps oriented to a position to create the greatest resistance, depicting a dorsiflexion exercise.

Referring to FIG. 7, when the user wants to use the pedals 1 to exercise perform a dorsiflexion exercise at maximum resistance, the user will position rear heel supports 9 at the midpoint of the pedals 1 so that the heel of the foot 16 is located above the pivoting joint structures 4 and use the foot restraints 10 to secure the foot 16. The user will then rotate his ankle counterclockwise and the rear resistance means 5, which take the form of elastic bands 23 in the preferred embodiment will stretch, creating resistance, and the front elastic bands 23 will sag, and not generate any resistance.

Figure 8:
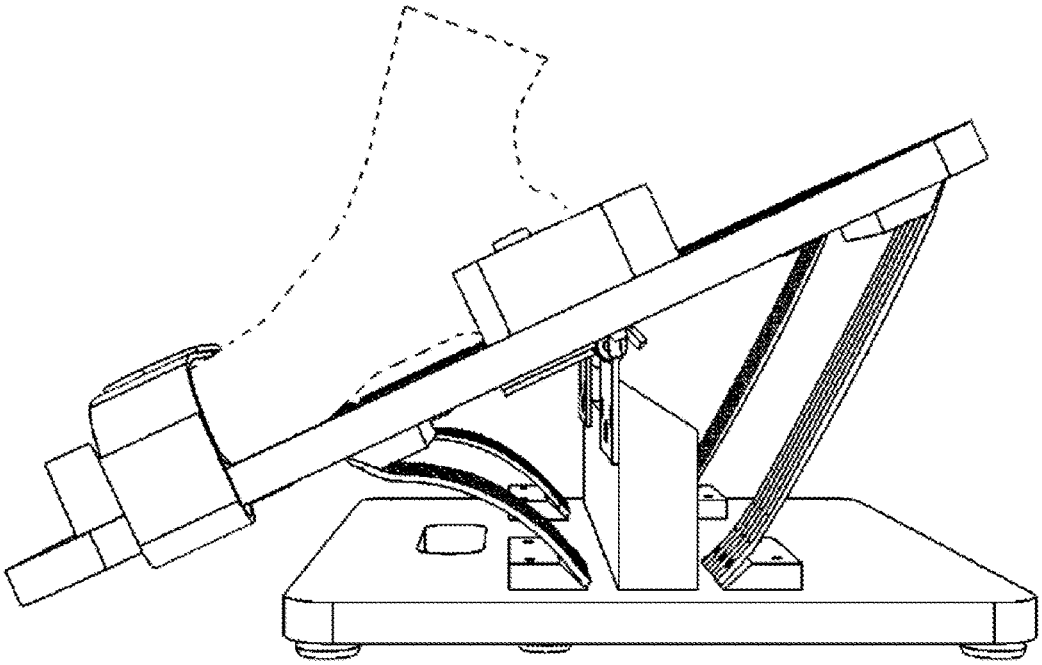
FIG. 8 illustrates a side view drawing of the therapeutic rehabilitation device where the pedals are facing up, for isolation exercising, with the heel piece and straps oriented to a position to create the greatest resistance, depicting a plantarflexion exercise.

Referring to FIG. 8, when the user wants to use the pedals 1 to exercise perform a plantarflexion exercise at maximum resistance, the user will position rear heel supports 9 at the rear of the pedals 1 so that the toe of the foot 16 is located above the pivoting joint structures 4 and use the foot restraints 10 to secure the foot 16. The user will then rotate his ankle clockwise and the front resistance means 5, which take the form of elastic bands 23 in the preferred embodiment will stretch, creating resistance, and the rear elastic bands 23 will sag, and not generate any resistance.

Figure 9:
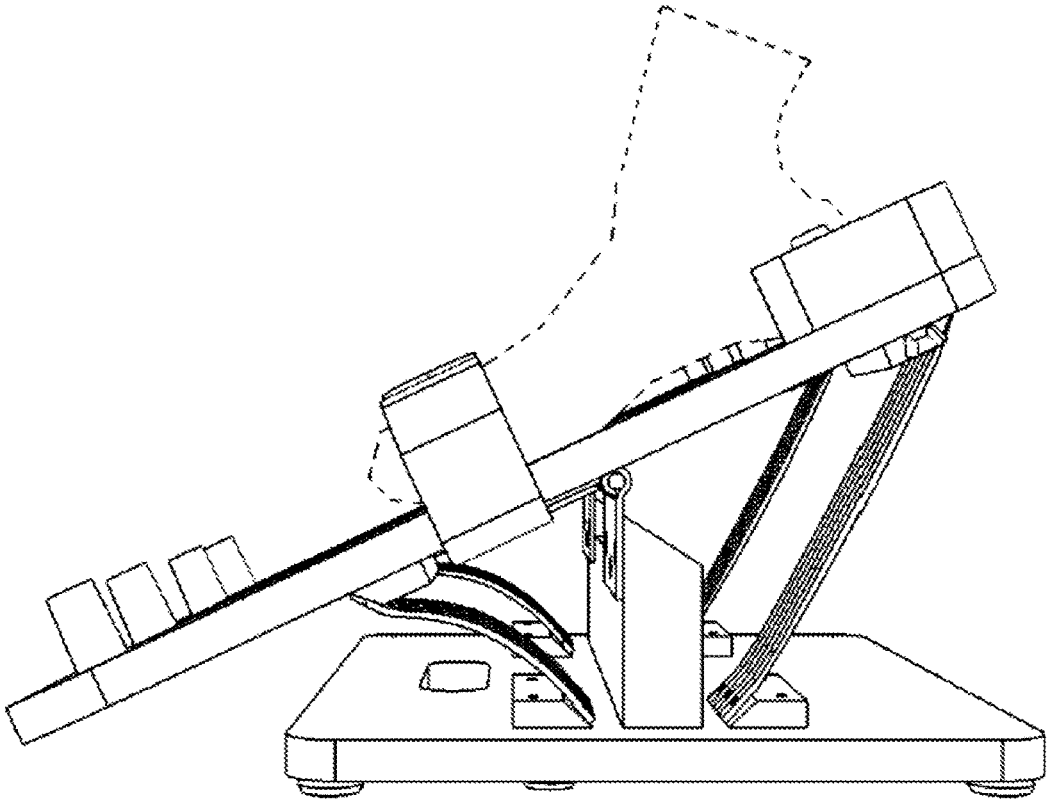
FIG. 9 illustrates a side view drawing of the therapeutic rehabilitation device where the pedals are facing up, for isolation exercising, with the heel piece and straps oriented to a position to create the least resistance, depicting a plantarflexion exercise.

Referring to FIG. 9, when the user wants to use the pedals 1 to exercise perform a plantarflexion exercise at minimum resistance, the user will position rear heel supports 9 at the rear of the pedals 1 so that the toe of the foot 16 is located above the pivoting joint structures 4 and use the foot restraints 10 to secure the foot 16. The user will then rotate his ankle counterclockwise and the rear resistance means 5, which take the form of elastic bands 23 in the preferred embodiment will stretch, creating resistance, and the front elastic bands 23 will sag, and not generate any resistance.

Figure 11:
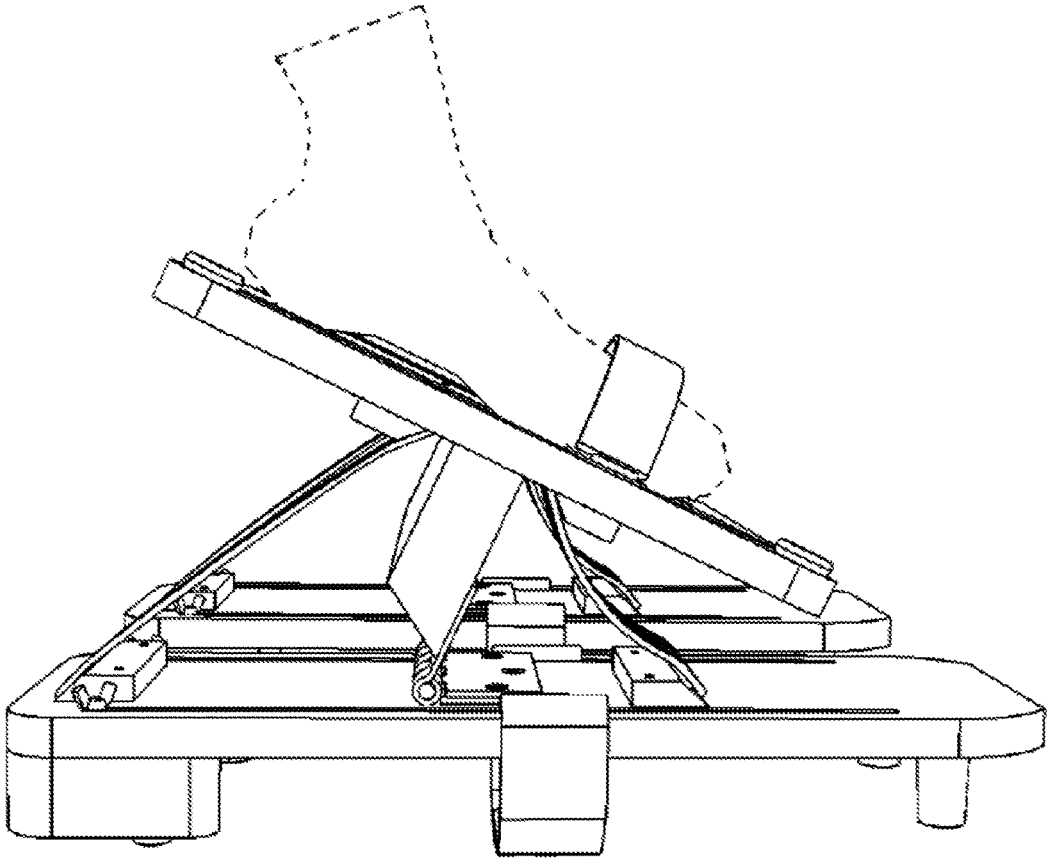
FIG. 11 illustrates a side view drawing of the therapeutic rehabilitation device where the large foot board is facing up, for active assistance exercising, depicting a plantarflexion exercise.

Referring to FIGS. 10 & 11, when the user wants to use the dual footboard piece 2 to exercise perform isolation exercises, the user will place the apparatus on the ground with the top of the pedals 1 facing the floor. The feet 22 will protect the floor from damage. The user will place their feet 16 on the footpads 17, and secure their feet to the dual footboard piece 2 with the foot restraints 18

When the user wants to perform a plantarflexion exercise the user rotate his ankles counterclockwise and the rear resistance means 5, which take the form of elastic bands 23 in the preferred embodiment will stretch, creating resistance, and the front elastic bands 23 will sag, and not generate any resistance.

When the user wants to perform a dorsiflexion exercise the user rotate his ankle clockwise and the front resistance means 5, which take the form of elastic bands 23 in the preferred embodiment will stretch, creating resistance, and the rear elastic bands 23 will sag, and not generate any resistance.

Figure 12:
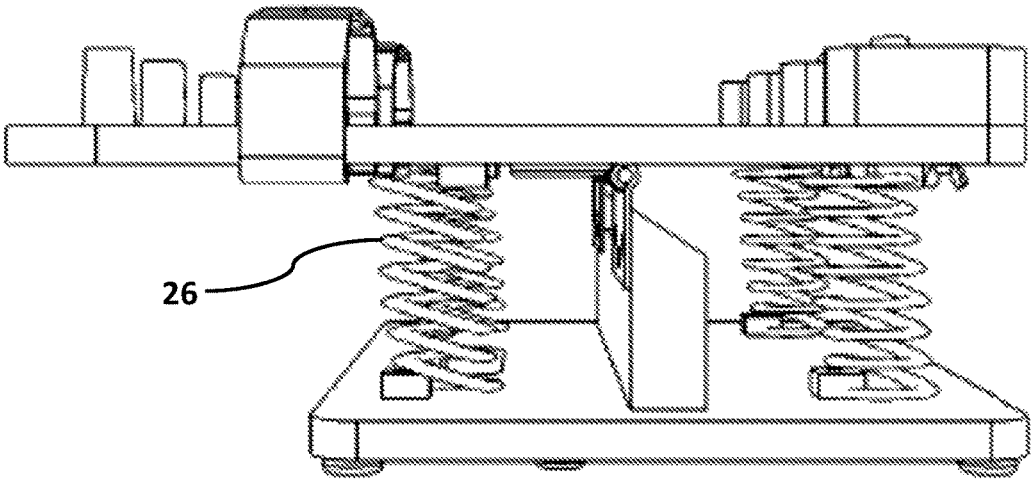
FIG. 12 illustrates a side view drawing of a first alternate embodiment of therapeutic rehabilitation device where the elastic bands have been replaced with springs.

FIG. 12 depicts an first alternate embodiment of the invention where the resistance means 5 is comprised of springs 26 in lieu of elastic bands 23. The benefit of using springs 26 in lieu of elastic bands 23 is that the springs can be connected directly to the pedals 1 and dual footboard piece 2 without the need for an angled wedge pieces 24. The downside of using springs 26 is over time, the springs 26 will fatigue, requiring replacement. Replacement of a spring will be more difficult and costly than elastic bands 23.

What is claimed is:

1. A therapeutic rehabilitation device for a lower leg section of a user, the therapeutic rehabilitation device comprising;

at least one first receiving member configured for a single foot of the user and comprising a topside configured for the single foot of the user to be placed thereupon, the at least one first receiving member further comprising a bottom, a heel end, a toe end, a midpoint, a heel support piece, a foot restraining device, and at least one guide which travels longitudinally from the heel end of the at least one first receiving member to the toe end of the at least one first receiving member;

a second receiving member configured for two feet of the user and comprising a topside configured for the two feet of the user to be placed thereupon, the second receiving member further comprising a bottom, a heel end and a toe end;

a pivoting adjoining member connecting the second receiving member to the at least one first receiving member at a location between the heel end and toe end of each of the respective receiving members, said pivoting adjoining member orienting the second receiving member and the at least one first receiving member such that the bottom of the second receiving member faces the bottom of the at least one first receiving member;

at least one first resistance device connecting the heel end of the at least one first receiving member to the second receiving member;

at least one second resistance device connecting the toe end of the at least one first receiving member to the second receiving member;

wherein, when the therapeutic rehabilitation device is placed on a surface with the topside of the at least one first receiving member facing the surface, the topside of the second receiving member faces upward, and can be resistibly pivoted for active assistance exercising;

wherein said heel support piece is connected to said at least one guide to allow the heel support piece to be adjusted longitudinally between the heel end of the at least one first receiving member and the toe end of the at least one first receiving member, and pivotal resistance can be adjusted during isolation exercising by adjusting a longitudinal location of the heel support piece along the at least one guide;

wherein, when the therapeutic rehabilitation device is placed on the surface with the topside of the second receiving member facing the surface, the topside of the at least one first receiving member faces upward, and can be resistibly pivoted for the isolation exercising.

2. The therapeutic rehabilitation device of claim 1, wherein a minimum travel distance for said at least one guide is from the heel end of the at least one first receiving member to the pivoting adjoining member.

3. The therapeutic rehabilitation device of claim 1, wherein said at least one first resistance device and said at least one second resistance device comprise elastic bands.

4. The therapeutic rehabilitation device of claim 1, wherein said at least one first resistance device and said at least one second resistance device comprise springs.

5. The therapeutic rehabilitation device of claim 1, wherein said foot restraining device comprises a pair of straps constructed with hook and loop material.

6. The therapeutic rehabilitation device of claim 1, wherein said second receiving member further comprises a pair of foot restraining devices.

7. A therapeutic rehabilitation device for a lower leg of a user, the therapeutic rehabilitation device comprising;

at least one receiving member configured for a single foot of the user and comprising a top configured for the single foot of the user to be placed thereupon, the at least one receiving member further comprising a bottom, a heel end, a toe end, a midpoint, a heel support piece, a foot restraining device, and at least one guide which travels longitudinally from the heel end to the toe end, wherein said heel support piece is connected to said at least one guide to allow the heel support piece to be adjusted longitudinally between the heel end and the toe end of the at least one receiving member;

a base member;

a pivoting adjoining member connecting the base member to the at least one receiving member at a location between the heel end and toe end of the at least one receiving member;

at least one first resistance device connecting the heel end of the at least one receiving member to the base member;

at least one second resistance device connecting the toe end of the at least one receiving member to the base member;

wherein, the therapeutic rehabilitation device can be resistibly pivoted for isolation exercising;

wherein, pivotal resistance can be adjusted during the isolation exercising by adjusting a longitudinal location of the heel support piece along the at least one guide.

8. The therapeutic rehabilitation device of claim 7, wherein a minimum travel distance for said at least one guide is from the heel end of the at least one receiving member to the pivoting adjoining member.

9. The therapeutic rehabilitation device of claim 7, wherein said at least one first resistance device and said at least one second resistance device comprise elastic bands.

10. The therapeutic rehabilitation device of claim 7, wherein said at least one first resistance device and said at least one second resistance device comprise springs.

* * * * *